US012704349B2

(12) United States Patent
Hanson et al.

(10) Patent No.: US 12,704,349 B2
(45) **Date of Patent: *Aug. 11, 2026**

(54) MULTI-SHOT AIRGUN

(71) Applicant: Crosman Corporation, Bloomfield, NY (US)

(72) Inventors: Jeffrey D. Hanson, Honeoye Falls, NY (US); Jeffrey W. Mock, Rochester, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/811,466

(22) Filed: Aug. 21, 2024

(65) Prior Publication Data

US 2026/0055989 A1 Feb. 26, 2026

(51) Int. Cl.
*F41B 11/54* (2013.01)
*F41B 11/648* (2013.01)

(52) U.S. Cl.
CPC ..... *F41B 11/54* (2013.01); *F41B 11/648* (2013.01)

(58) Field of Classification Search
CPC ..... F41B 11/54; F41B 11/646; F41B 11/647; F41B 11/648
USPC ..... 124/48, 66
See application file for complete search history.

(56) References Cited

U.S. PATENT DOCUMENTS 2,855,715 A 10/1958 Weimer
3,782,359 A * 1/1974 Kester ..... F41B 11/62 124/48
4,422,433 A * 12/1983 Milliman ..... F41A 9/28 124/48
9,664,475 B1 5/2017 Maggiore
12,429,302 B2 * 9/2025 Hanson ..... F41B 11/54
2002/0059925 A1 5/2002 Casas Salva
2011/0146645 A1 6/2011 Ma
2017/0160029 A1 * 6/2017 Huang ..... F41A 9/27
2020/0096287 A1 3/2020 Miller et al.
2020/0232749 A1 7/2020 Call
2020/0263950 A1 8/2020 Call
2020/0363157 A1 * 11/2020 Colby ..... A01M 27/00
2021/0095935 A1 4/2021 Chia
2021/0102776 A1 4/2021 Lamboy (Continued)

FOREIGN PATENT DOCUMENTS

GB 2244121 A 11/1991
IT 201700102084 A1 3/2019

OTHER PUBLICATIONS

International Search Report and Written Opinion for International Application No. PCT/US2024/046862, dated Nov. 13, 2024, 13 pages.

(Continued)

*Primary Examiner* — Bret Hayes
(74) *Attorney, Agent, or Firm* — Lee & Hayes, P.C.

(57) ABSTRACT

Break barrel airguns are provided with a loading system that uses the cocking action of the break barrel type airgun to charge an energy storing device. A rotary style magazine is provided that enables multi-shot capability for the airgun. The magazin is held by a magazine holder and engages with engagement components that reduce backlash, prevent backwards rotation of the magazine, and ensure alignment of the projectile holders in the magazine with the opening of the barrel.

19 Claims, 15 Drawing Sheets

(56) References Cited

U.S. PATENT DOCUMENTS

| | | | |
|---|---|---|---|
| 2021/0318095 | A1 | 10/2021 | Call et al. |
| 2021/0356229 | A1 | 11/2021 | Call |
| 2022/0221245 | A1 | 7/2022 | Arnedo Vera |
| 2024/0003653 | A1 | 1/2024 | Call |
| 2025/0102268 | A1 | 3/2025 | Hanson |

OTHER PUBLICATIONS

Office Action for U.S. Appl. No. 18/371,411, dated Apr. 21, 2025, 11 pages.
Partial Search Report for European Application No. 25196846.7, dated Jan. 21, 2026, 14 pages.

* cited by examiner

MULTI-SHOT AIRGUN

FIELD OF THE INVENTION

This invention relates to airguns of the break barrel type.

BACKGROUND OF THE INVENTION

Conventional break barrel airguns provide a stock and receiver that are joined to a barrel by way of a hinge. The receiver houses a spring into which energy is stored, a trigger for releasing the stored energy of the spring to drive a piston into a compression tube having a transfer port that communicates pressure from the compression tube to a breech end of the barrel. In such airguns, the barrel is hingedly joined to the receiver. When the user wishes to use the break barrel airgun, the user rotates the barrel relative to the stock and receiver. This separates the breech end of the barrel from the transfer port allowing a pellet to be loaded therein. After loading the user rotates the barrel to a position where the breech end of the barrel is positioned proximate to the transfer port. The barrel is also connected to the spring in a manner that causes the energy to be stored in the spring as the break barrel is moved during the loading process.

While the acts of rotating the barrel to and from the loading position can be conducted rather quickly. The process of manually loading an individual pellet into the breech end of a barrel while holding an airgun can be challenging and can extend the time between shots significantly.

BRIEF SUMMARY OF THE INVENTION

One general aspect includes an airgun having a multi-shot magazine. The airgun includes a breech that may include a first face with a port from which a compressed gas can flow. The airgun also includes a barrel defining a passageway through the barrel with an opening at a back barrel face with the passageway sized to receive a projectile. The airgun further includes a pivot joining the barrel to the breech such that the barrel can be moved between a firing position where the opening is positioned to receive the compressed gas and a cocking position. The airgun includes a rotary magazine that includes a turret having a plurality of projectile holders arranged around a central axis of the turret, a center channel positioned at the central axis of the turret, the turret configured to rotate around the center channel, and a first engagement component positioned around the center channel. The first engagement component is configured to reduce backlash and prevent backwards rotation of the turret. The airgun further includes a magazine holder adapted to position a projectile holder of the plurality of projectile holders in alignment with the passageway. The magazine holder includes an arbor, a spring, and a second engagement component coupled to the arbor and biased into contact with the rotary magazine by the spring, the second engagement component configured to interface with the first engagement component.

In some examples, the first engagement component may include a first plurality of angled surfaces, the first plurality of angled surfaces disposed around the central axis of the turret and may include a step between adjacent angled surfaces of the first plurality of angled surfaces. In some examples, the second engagement component may include a second plurality of angled surfaces, the second plurality of angled surfaces disposed around the arbor and may include a second step between adjacent angled surfaces of the second plurality of angled surfaces. In some examples, the second engagement component may include a first semi-circular portion may include the second plurality of angled surfaces and a second semi-circular potion may include a planar surface. In some examples, the airgun may further include a first seal positioned around the opening at the back barrel face configured to interface with a first surface of the turret and a second seal positioned around the port at the breech and configured to interface with a second surface of the turret. In some examples, the first engagement component and the second engagement component are configured to interface to translate the turret along the arbor during rotation of the turret from a first position along a length of the arbor to a second position along the length of the arbor before returning to the first position, where at the first position, the projectile holder of the plurality of projectile holders is aligned with the passageway. At the first position, a seal of the breech is in contact with the turret to seal around the projectile holder. In some examples, the opening of the barrel may include a chamfer around a perimeter of the opening configured to guide a projectile into the passageway. In some examples, the first engagement component and the second engagement component are further configured to interface to bias rotation of the turret such that the plurality of projectile holders are aligned with the passageway.

BRIEF DESCRIPTION OF THE DRAWINGS

The detailed description is set forth below with reference to the accompanying figures. The use of the same reference numbers in different figures indicates similar or identical items. The first digit of the reference number refers to the figure in which the item first appears. The systems depicted in the accompanying figures are not to scale and components within the figures may be depicted not to scale with each other.

DESCRIPTION OF THE INVENTION

Figure 1:
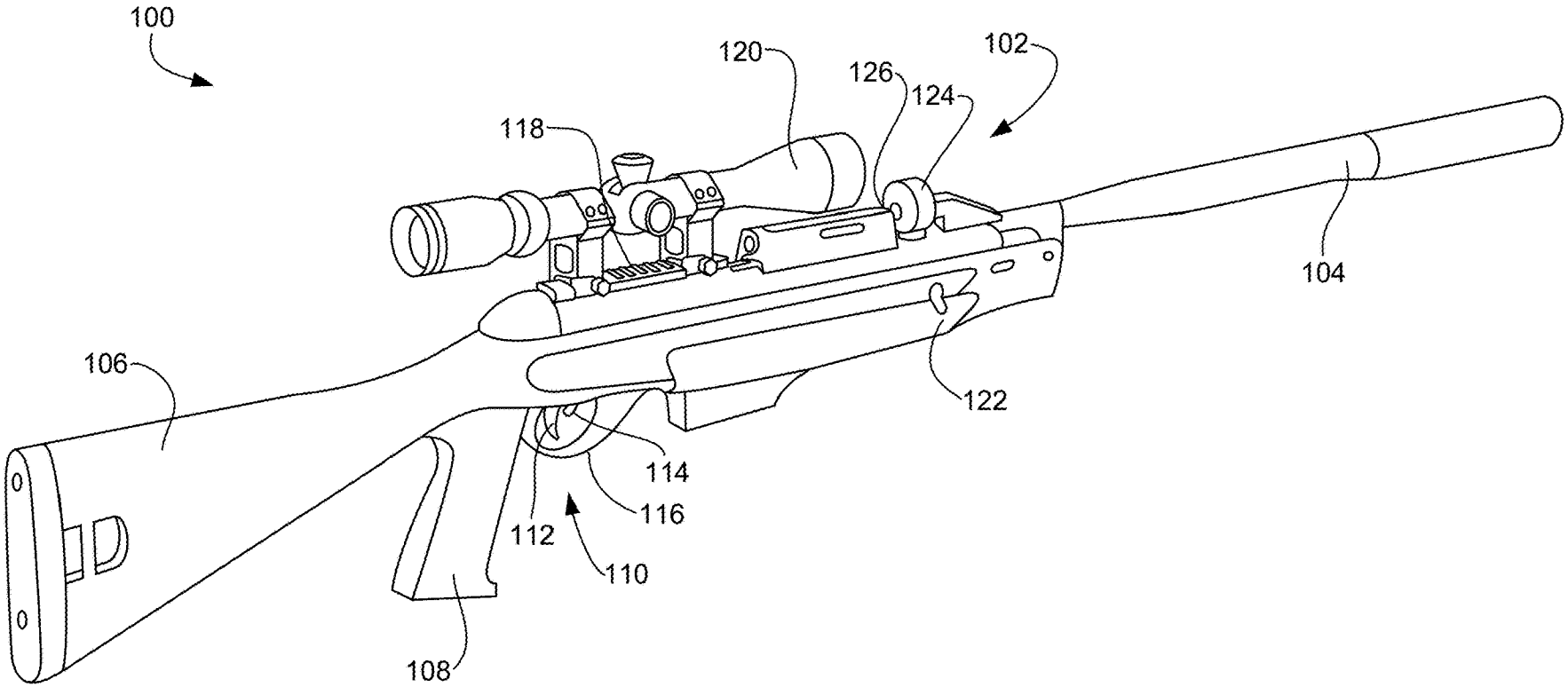
FIG. 1 illustrates a perspective view of a multi-shot airgun according to at least one example.

FIG. 1 illustrates a perspective view of a multi-shot airgun 100 according to at least one example, the airgun 100 has a stock 106 with a grip handle 108, forestock 122 and mounting rail 118, having an optional scope 120, a trigger system 110, with a trigger 112, a safety 114 and trigger guard 116. Airgun 100 also has a barrel 104 through which projectiles (not shown) such as pellets are thrust toward a target. In this embodiment a breech 102 holds a magazine 124 containing a plurality of projectiles in a magazine holder supported by a magazine holder 126.

In the airgun 100, pellets or other such projectiles may be loaded into the magazine 124 and the pellets are shot from the magazine 124 into the breech and barrel 104 during firing. Accordingly, alignment between a projectile holder of the magazine 124 and the barrel opening is important to ensure pellets are able to fire accurately and without obstruction due to misalignment. The magazine 124 is configured not to deform the pellet geometry during loading and firing. Accordingly there may be tight or minimal clearance between the pellet and the projectile holder, e.g., similar in diameter to the passage defined within the barrel 104. The magazine 124 may be manually indexed during a cocking cycle, or may be automated in some embodiments to automatically advance after firing and/or during a cycle of the airgun 100.

The magazine 124 may remain connected and/or coupled with the breech 102 during loading, firing, re-loading, and other interactions with the airgun 100. The magazine 124 may be removed for service in some examples. The magazine 124 may be loaded while the breech 102 is open and/or by manually indexing the magazine 124 and loading at an open portion of the magazine 124. The magazine 124 may be fitted within a cover to prevent the pellets from coming out during shooting. The cover may snap on or otherwise couple to the magazine 124 such that the magazine 124 rotates freely relative to the cover. The cover need not be removed during pellet loading. The cover may include one or more cutouts or open portions such that loaded pellets can be seen by the user during operation.

The magazine 124 may be formed of a polymer, such as Delrin, or other such resilient material including polymers, metals, plastics, composites, and other such materials. Accordingly, the magazine 124 may be capable of withstanding dry-firing of the airgun 100.

The magazine 124 may further include indexing teeth to aid in positioning and may be spring loaded to help reduce backlash and/or movement of the magazine 124 during operation in order to maintain alignment of the projectile holders of the magazine 124 during firing and other interactions. Accordingly, the magazine 124 may be supported by a magazine holder 126 that includes an engaging feature that enables the magazine to rotate in only one direction, e.g., clockwise, and enables the magazine 124 to rotate indefinitely (without winding or a physical stop). The barrel 104, specifically the opening at the breech 102 may have a lead-in chamfer to aid with any potential mis-alignment. The indexing teeth may include angled planar surfaces with steps in-between adjacent angled planar surfaces and the indexing teeth of the magazine holder 126 may interface with indexing teeth of the magazine 124 to enable the rotation and alignment features. The indexing teeth may be biased into contact with one another through the use of a spring incorporated within the magazine holder 126 and/or magazine 124.

It will be appreciated that such misalignment can happen in various ways, along a vertical axis, along a horizontal axis, or both as may occur in the event that shuttle 54 is allowed to slide vertically at a cant and that given the requirements for alignment, thermal and other environmental factors can also impact alignment.

Such concerns place a significant burden on the design of such a system in that a conventional manner of addressing such requirements is to impose exacting constraints on the design of such systems and the materials used such a system. However, such approaches add cost, weight, and complexity which may not be useful in field environments. Alternatively, user adjustment controls can be provided however the need for constant adjustments this creates usability problems.

The indexing teeth on the magazine holder 126 of the breech 102 may include a feature having angled planar surfaces that correspond with the indexing teeth of the magazine 124 and may interact together. The indexing teeth of the magazine holder 126 may include an injection molded component, metal component, composite, plastic, or other such material that is pressed into the breech 102 or otherwise held in place while the magazine 124 can freely rotate.

The indexing teeth and a spring of the magazine holder 126 may interact to bias the magazine 124 into contact and alignment with the magazine holder 126. The angled surfaces of the indexing teeth on the magazine 124 and the magazine holder 126 may cause the magazine 124 to move laterally away from the magazine holder, for example along a length of an arbor on which the magazine 124 rotates. After the magazine 124 rotates to the next position of a projectile holder, the step of the indexing teeth results in the magazine 124 moving laterally back into contact with the magazine holder 126. Accordingly, the biasing member (e.g., spring) and the indexing teeth may reduce backlash, prevent backwards rotation of the magazine 124, and maintains alignment of the projectile holders with the passageway of the barrel 104. The indexing teeth are shown and described in further detail with respect to FIGS. 10A-B herein.

The biasing member and the indexing teeth may work together to bias rotation of the magazine 124 such that the projectile holders of the magazine 124 are aligned with the passage of the barrel 104. In this manner, the indexing teeth may act as a pawl mechanism that allows backwards rotation to a degree, but only allows backwards rotation until the projectile holder and the passage of the barrel 104 are aligned. The biasing member causes the angled surfaces of the indexing teeth to engage such that the backwards rotation to the 'stop' of the pawl mechanism is induced through the force applied by the biasing member to ensure alignment of the projectile holder of the magazine 124 and the barrel 104.

One or more seals may be positioned on either side of the magazine 124 to seal around the projectile holder and thereby create a sealed passageway from a compressed air source through to the passageway of the barrel 104 without any leaks. The seals may compress against the magazine 124 and may be formed of a material that may seal around the pellet yet also compress enough to not restrict rotation of the magazine or prevent the barrel 104 from latching during lockup. Accordingly, during rotation of the magazine 124, the lateral movement of the magazine 124 described herein may result in the magazine 124 losing contact with the seal during rotation before re-contacting the seal when the next projectile position is reached.

Figure 2:
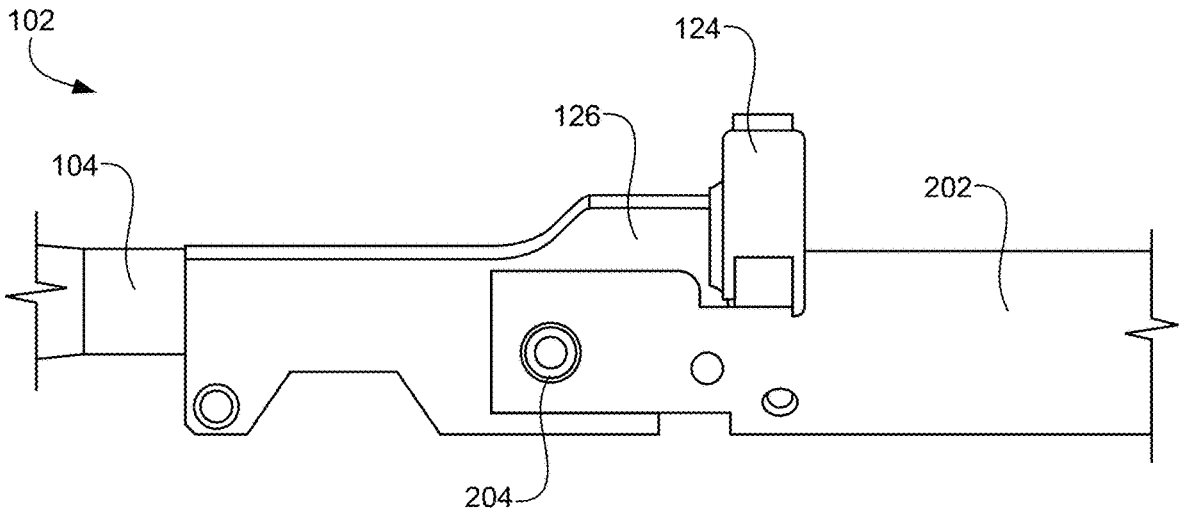
FIG. 2 illustrates a side view of a breech portion of a multi-shot airgun, according to at least one example.
Figure 4:
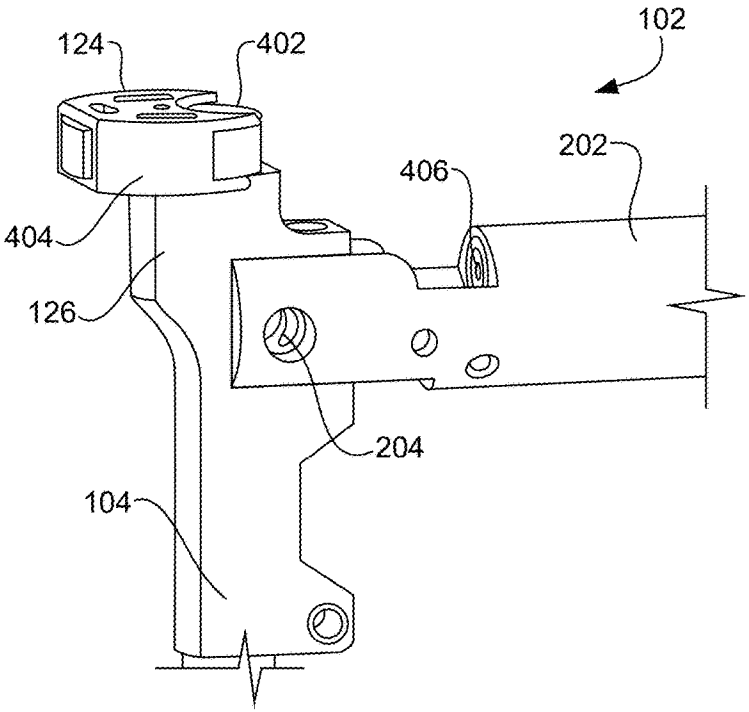
FIG. 4 illustrates an open breech of a multi-shot airgun, according to at least one example.

One general aspect described herein includes an airgun 100 having a magazine 124 for providing multi-shot capability to the airgun 100. The airgun 100 includes a breech 102 that may include a first face with a port from which a compressed gas can flow. The airgun 100 also includes a barrel 104 defining a passageway through the barrel 104 with an opening at a back barrel face with the passageway sized to receive a projectile. The airgun 100 further includes a pivot joining the barrel 104 to the breech 102 such that the barrel 104 can be moved between a firing position where the opening is positioned to receive the compressed gas and a cocking position, for example as depicted in FIGS. 2 and 4. The airgun 100 includes a rotary magazine 124 that includes a turret having a plurality of projectile holders arranged around a central axis of the turret, a center channel positioned at the central axis of the turret, the turret configured to rotate around the center channel, and a first engagement component positioned around the center channel. The first engagement component is configured to reduce backlash and prevent backwards rotation of the turret. The airgun 100 further includes a magazine holder 126 adapted to position a projectile holder of the plurality of projectile holders in alignment with the passageway. The magazine holder 126 includes an arbor, a spring, and a second engagement component coupled to the arbor and biased into contact with the rotary magazine by the spring, the second engagement component configured to interface with the first engagement component.

In some examples, the first engagement component may include a first plurality of angled surfaces, the first plurality of angled surfaces disposed around the central axis of the turret and may include a step between adjacent angled surfaces of the first plurality of angled surfaces. In some examples, the second engagement component may include a second plurality of angled surfaces, the second plurality of angled surfaces disposed around the arbor and may include a second step between adjacent angled surfaces of the second plurality of angled surfaces. In some examples, the second engagement component may include a first semi-circular portion may include the second plurality of angled surfaces and a second semi-circular potion may include a planar surface. In some examples, the airgun 100 may further include a first seal positioned around the opening at the back barrel face configured to interface with a first surface of the turret and a second seal positioned around the port at the breech 102 and configured to interface with a second surface of the turret. In some examples, the first engagement component and the second engagement component are configured to interface to translate the turret along the arbor during rotation of the turret from a first position along a length of the arbor to a second position along the length of the arbor before returning to the first position, where at the first position, the projectile holder of the plurality of projectile holders is aligned with the passageway within the barrel 104. At the first position, a seal of the breech 102 is in contact with the turret to seal around the projectile holder. In some examples, the opening of the barrel 104 may include a chamfer around a perimeter of the opening configured to guide a projectile into the passageway. In some examples, the first engagement component and the second engagement component are further configured to interface to bias rotation of the turret such that the plurality of projectile holders are aligned with the passageway.

FIG. 2 illustrates a side view of a breech 102 of a multi-shot airgun 100, according to at least one example. The breech 102 connects between the barrel 104 and a stock portion 202 that stores an energy storage device, such as a compressed gas storage container and/or a spring device to store energy that may be used to fire a pellet from the magazine 124 through the barrel 104. The magazine 124 is held in place by the magazine holder 126 as described herein. The barrel 104 and the stock portion 202 connect at a pivot 204. The pivot 204 enables a user to break open the breech 102 to separate the barrel 104 from the stock portion 202 to provide access to the magazine 124 for loading pellets or other projectiles for firing from the airgun 100.

Figure 3:
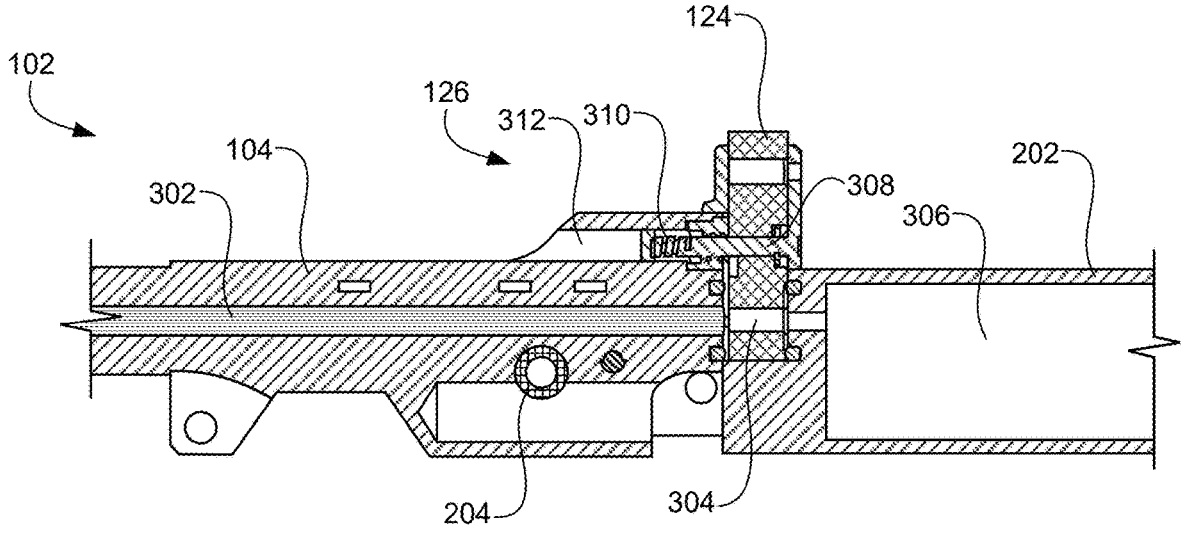
FIG. 3 illustrates a section view of the breech portion of the multi-shot airgun of FIG. 2.

FIG. 3 illustrates a section view of the breech 102 of the multi-shot airgun 100 of FIG. 2. The section view illustrates the barrel 104 and stock portion 202 coupled at the breech 102 and configured to rotate relative to one another around pivot 204. FIG. 3 also illustrates internal components of the breech 102 to enable the use of a rotary magazine, e.g., magazine 124, for multi-shot capability of the airgun 100.

The barrel 104 defines a passageway 302 along the length of the barrel 104 through which a pellet is fired from the airgun 100. The pellet rests in a projectile holder 304 of the magazine 124. The magazine 124 may include a plurality of projectile holders, such as, for example, six projectile holders to provide six shots before the magazine 124 is reloaded. In some examples, the magazine 124 may hold fewer or greater than six pellets in some examples. The stock portion 202 includes a chamber 306 for storing compressed gas that may be used to fire a pellet from the projectile holder 304 down the passageway 302.

The magazine 124 is held in place at the breech 102 by the magazine holder 126. In the example illustrated in FIG. 3, the magazine holder 126 includes a channel 312 that contains a arbor 308 as well as a biasing element 310. The biasing element 310 is used to maintain the magazine 124 in contact with indexing teeth, as described herein. In particular, the biasing element 310 may cause indexing teeth to maintain alignment of the projectile holder 304 with the passageway 302. The details of the indexing teeth and further details of the magazine holder 126 and magazine 124 are shown and described with respect to FIGS. 9-10.

Figure 13:
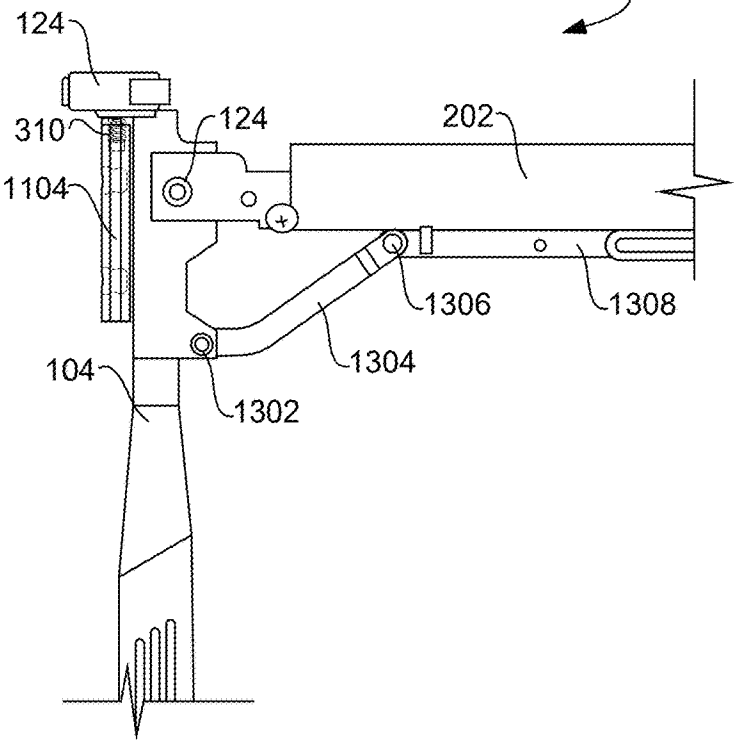
FIG. 13 illustrates an open breech for a multi-shot airgun equipped with a retrofit magazine, according to at least one example.

FIG. 4 illustrates the breech 102 of the airgun 100 in an open configuration, according to at least one example. The breech 102 includes the barrel 104 and stock portion 202 described above, as well as a pivot 204 that enables the breech 102 to open as illustrated in FIG. 4 for loading of the magazine 124. The breech 102 is illustrated in the open configuration which may be used for loading the magazine 124 with pellets as well as for providing compression to the chamber 306 through a linkage (e.g., as shown in FIG. 13) to compress a gas that may be used to launch one or more projectiles from the airgun 100.

Figure 5:
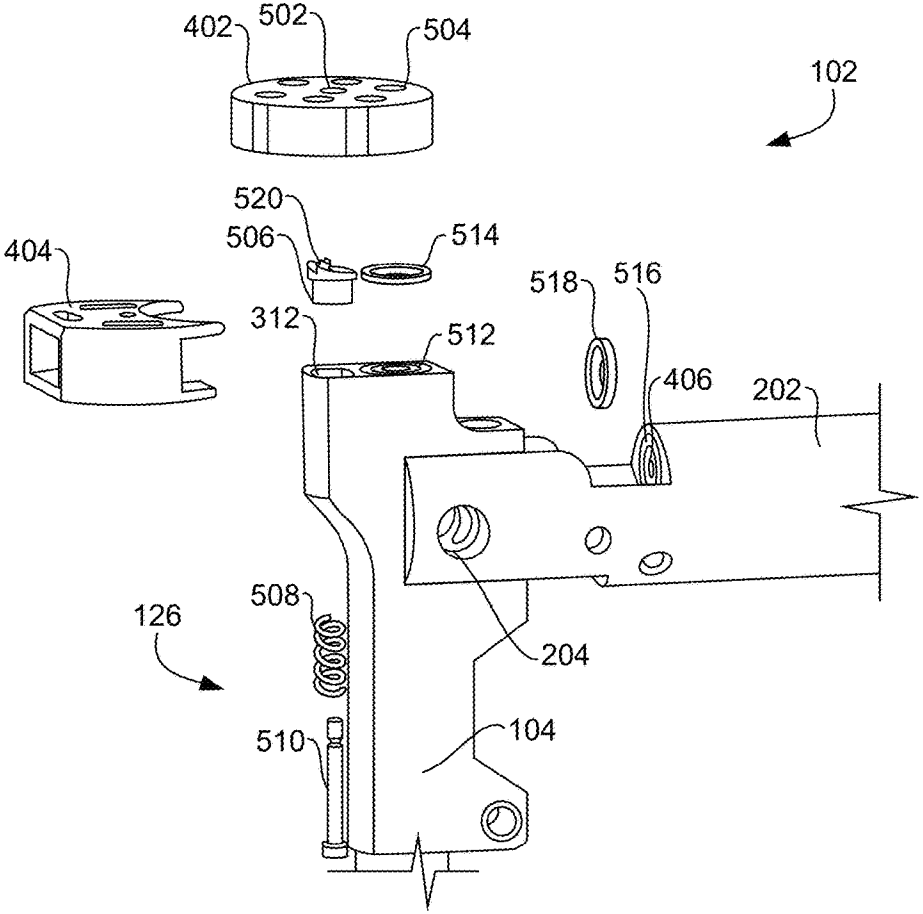
FIG. 5 illustrates an exploded view of the open breech of the multi-shot airgun of FIG. 4.

The breech 102 includes the magazine 124 that has a turret 402 and a cover 404. The turret is shown in FIG. 5 as including a central axis including a pivot 502 that may receive an arbor of the magazine holder 126. The turret 402 includes a plurality of projectile holders 504 distributed around the turret 402. The cover 404 may include passages or openings for viewing whether the projectile holders 504 are loaded or unloaded. The cover 404 also ensures that projectiles in the projectile holders 504 do not fall out or become dislodged during use of the airgun 100.

The magazine 124 is held in place by the magazine holder 126 that includes multiple components to maintain the magazine 124 in position and enable rotation of the magazine 124 to advance to a subsequent projectile for firing. The magazine holder 126 includes the channel 312 described herein as well as an arbor 510, spring 508, and first engagement component 506.

The arbor 510 is inserted into the channel 312 with the spring on the arbor 510. An end of the arbor 510 rests within the first engagement component 506. In some examples, the end of the arbor 510 may extend through the first engagement component 506 and into the pivot 502 of the magazine 124. In some examples, the arbor 510 may thread into the back of the first engagement component 506 such that the first engagement component 506 can move laterally along the direction of the channel 312 while interfacing with an engagement component of the magazine 124.

In some examples, the first engagement component 506 may be pressed or secured into the end of the channel 312 with a passage through the first engagement component 506 such that the arbor 510 passes through and secures into the pivot 502 of the magazine 124. In this example, the spring 508 provides a biasing force to maintain the magazine 124, and specifically the engagement component of the magazine 124 to remain in contact and engagement with the first engagement component 506.

The indexing teeth of the first engagement component 506 may include a feature having angled planar surfaces that correspond with the indexing teeth of the magazine 124 and may interact together. The indexing teeth of the first engagement component 506 may include an injection molded component, metal component, composite, plastic, or other such material that is pressed into the breech 102 at the channel 312 or otherwise held in place while the magazine 124 can freely rotate. The magazine 124 is retained by being secured to the arbor 510 with the spring 508 positioned around the shaft of the arbor to provide a biasing force that allows lateral movement of the magazine 124 in a limited range.

The indexing teeth of the first engagement component and the spring 508 of the magazine holder 126 may interact to bias the magazine 124 into contact and alignment with the magazine holder 126. The angled surfaces 520 of the first engagement component 506 and on the magazine 124 may cause the magazine 124 to move laterally away from the magazine holder 126, for example along an axis aligned with the channel 312. The angled surfaces 520 engage with the plurality of angled surfaces 604 of the turret depicted in FIGS. 6 and 7. Accordingly, the angled surfaces interact to cause the turret to rotate and stop in alignment of the projectile holders 504 with the barrel. After the magazine 124 rotates to the next position of a projectile holder, the step of the indexing teeth results in the magazine 124 moving laterally back into contact with the magazine holder 126. Accordingly, the biasing member (e.g., spring 508) and the indexing teeth of the first engagement component 506 may reduce backlash, prevent backwards rotation of the magazine 124, and maintains alignment of the projectile holders with the passageway of the barrel 104.

The breech 102 shows an opening 512 in a face of the breech 102 adjacent the barrel 104 through which projectiles enter the barrel 104. The opening 512 may include a chamfer around a perimeter of the opening to aid projectiles in entering the opening 512 from the magazine 124. The opening 512 may also be surrounded by a channel wherein a seal 514 is situated. The seal 514 may rest within the channel around the opening 512 to seal around the projectile holder and thereby create a sealed passageway from a compressed air source through to the passageway of the barrel 104 without any leaks. The seal 514 may compress against the magazine 124 and may be formed of a material that may seal around the pellet yet also compress enough to not restrict rotation of the magazine 124 or prevent the barrel 104 from latching during lockup. Accordingly, during rotation of the magazine 124, the lateral movement of the magazine 124 described herein may result in the magazine 124 losing contact with the seal 514 during rotation before re-contacting the seal 514 when the next projectile position is reached.

The stock portion 202 and conduit 406 may be surrounded by a seal 518 that rests within a channel 516 such that when the breech 102 is in the closed configuration, the seal 518 contacts the face of the stock portion 202 as well as the face of the magazine 124 to seal a passage between the conduit 406 and the projectile holder 504.

Figure 6:
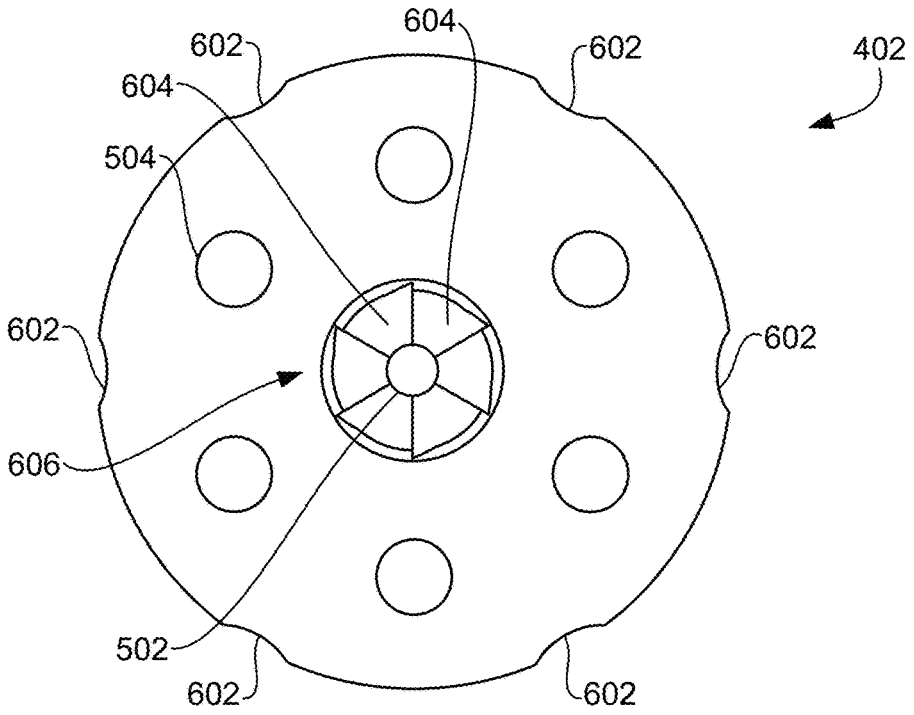
FIG. 6 illustrates a turret for holding pellets in a multi-shot airgun, according to at least one example.
Figure 7:
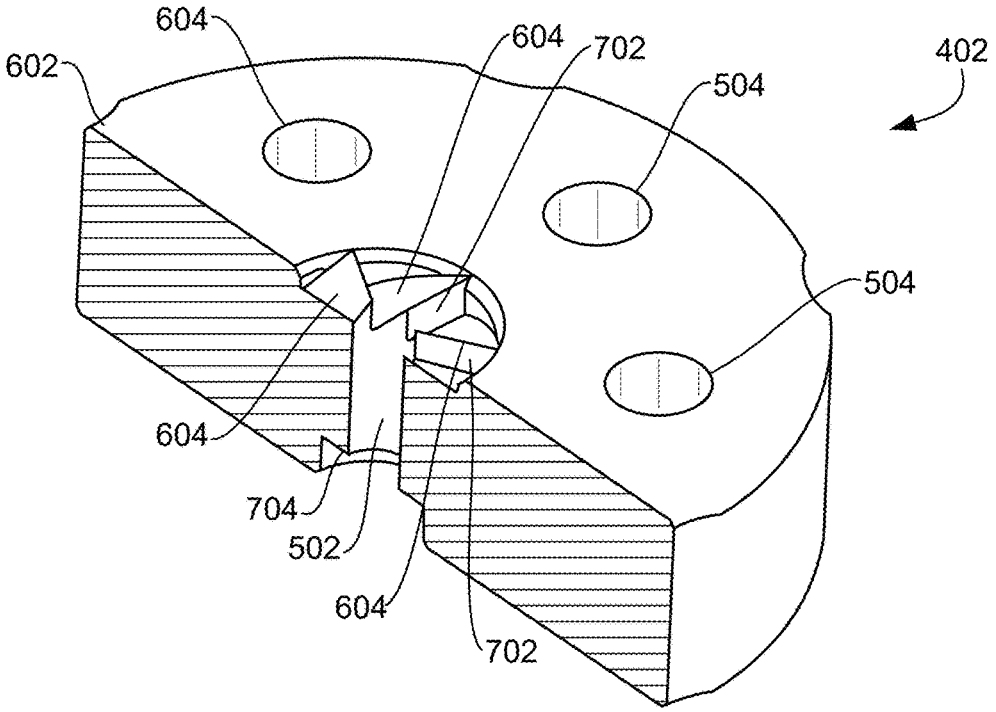
FIG. 7 illustrates a section view of the turret of FIG. 6.

FIGS. 6 and 7 illustrate a turret 402 for holding pellets in a multi-shot airgun, according to at least one example. The turret 402 includes a pivot 502 at a center of the turret 402 around which the turret 402 may rotate to present projectiles from the various projectile holders 504 to the opening of the barrel 104. The turret 402 includes a second engagement component 606 that may engage with the first engagement component 506 of the breech 102.

The second engagement component 606 may include a plurality of angled surfaces 604, the plurality of angled surfaces 604 disposed around the pivot 502 of the turret 402 and may include a step 702 between adjacent angled surfaces of the plurality of angled surfaces 604. In some examples, the second engagement component 606 may include a first semi-circular portion may include the second plurality of angled surfaces and a second semi-circular potion may include a planar surface as shown and described in FIG. 8.

The indexing teeth of the second engagement component 606 may include angled planar surfaces with steps 702 in-between adjacent angled planar surfaces and the indexing teeth may interface with indexing teeth of the first engagement component 506 to enable the rotation and alignment features. The indexing teeth may be biased into contact with one another through the use of a spring 508 incorporated within the magazine holder 126 and/or magazine 124.

The indexing teeth and the spring associated with the magazine 124 may interact to bias the magazine 124 into contact and alignment with the magazine holder 126. The angled surfaces of the indexing teeth on the magazine 124 and the magazine holder 126 may cause the magazine 124 to move laterally away from the magazine holder, for example along a length of an arbor on which the magazine 124 rotates. After the magazine 124 rotates to the next position of a projectile holder, the step 702 of the indexing teeth results in the magazine 124 moving laterally back into contact with the magazine holder 126. Accordingly, the biasing member (e.g., spring) and the indexing teeth may reduce backlash, prevent backwards rotation of the magazine 124, and maintains alignment of the projectile holders with the passageway of the barrel 104.

The turret 402 includes a profile 704 that may enable a securing device such as a nut or other component that may releasably secure to the arbor to interact with the turret 402, for example to engage the first engaging component 506 and the second engaging component due to the force of the spring 508 along the arbor 510. The turret 402 also includes exterior profiles 602 that may provide for user engagement with the turret 402 through the cover 404 to rotate the turret 402 to provide a subsequent projectile to the opening of the barrel 104.

Figure 8:
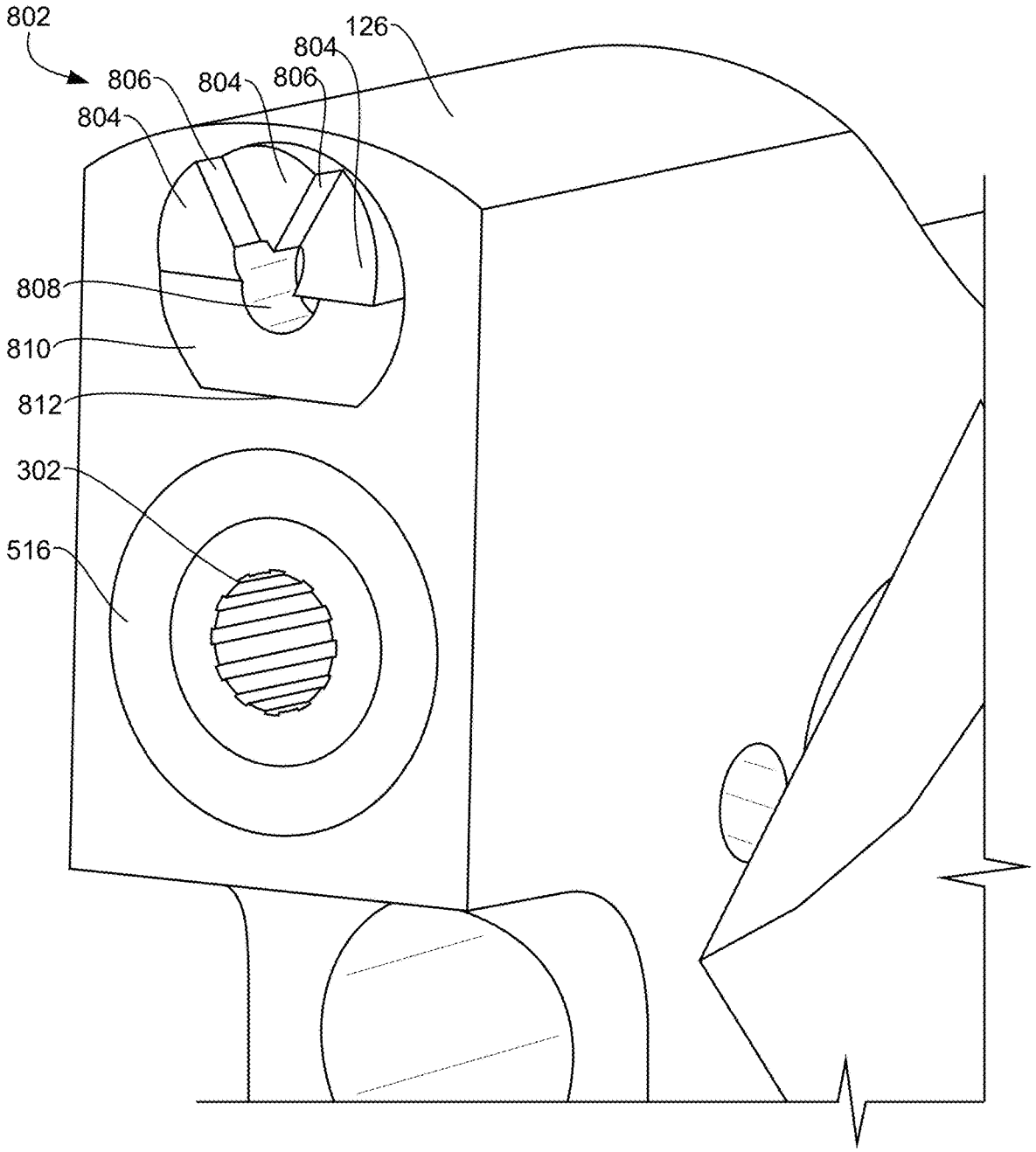
FIG. 8 illustrates a barrel-end portion of a breech of a multi-shot airgun, according to at least one example.

FIG. 8 illustrates a barrel-end portion of a breech 102 of a multi-shot airgun 100, according to at least one example. The barrel-end portion includes a magazine holder 126 as described herein as well as a passageway 302 for the barrel 104 and the channel 516 for the seal 518 previously described. The barrel-end portion includes an engagement component 802 that may be similar and/or identical to the first engagement component 506. The engagement component 802 includes an insert that may be pressed or otherwise secured into the body of the breech 102 at the barrel-end, specifically within the channel 312 of the magazine holder 126. The engagement component 802 includes a central passageway 808 that enables the arbor 510 to pass through from the channel 312 to the magazine 124 to secure the magazine 124 to the magazine holder 126.

The engagement component 802 includes angled surfaces 804 and steps 806 as described herein. The angled surfaces 804 and steps 806 may only cover a portion of the engagement component 802 in some examples. In some examples, the engagement component 802 may be entirely covered with angled surfaces 804 and steps 806.

A flat portion 810 of the engagement component 802 may be flat, without the angled surfaces 804 and steps 806. In some examples, the engagement component 802 may include angled surfaces 804 and steps 806 around the entire perimeter of the engagement component. In some examples, the flat portion 810 may enable the system to accurately engage and align with the magazine holder 126. Additionally, the engagement component 802 is shown as cylindrical in shape with a flat side 812. The flat side 812 may correspond to a flat portion of a perimeter of the channel 312. The flat side 812 and the perimeter of the channel 312 may engage to ensure that the engagement component 802 is accurately positioned to ensure proper positioning and alignment of the projectile holders with the passageway 302.

Figure 9:
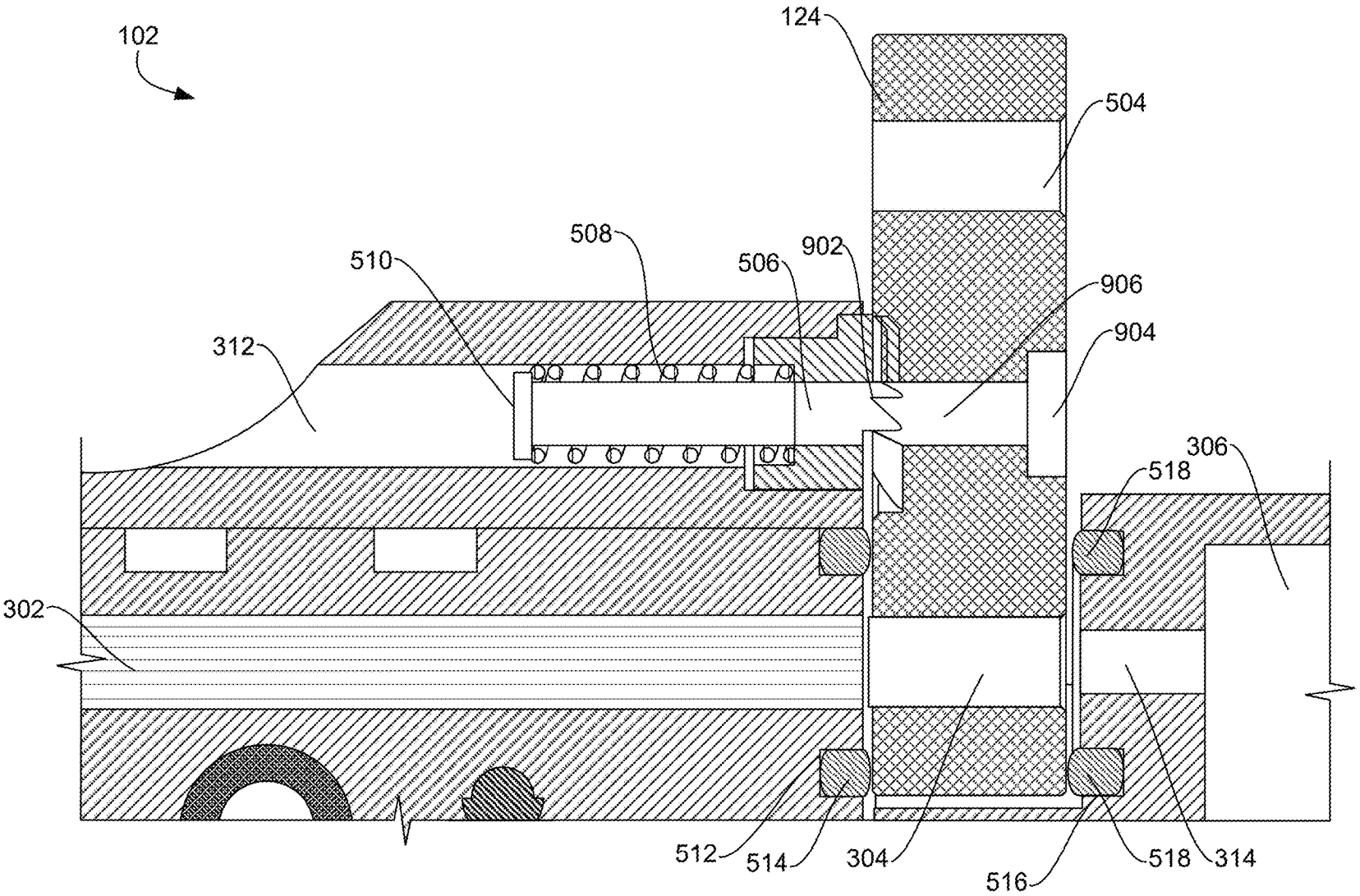
FIG. 9 illustrates a section view of the barrel-end portion of the breech of FIG. 8 and a magazine for a multi-shot airgun, according to at least one example.
Figure 10A:
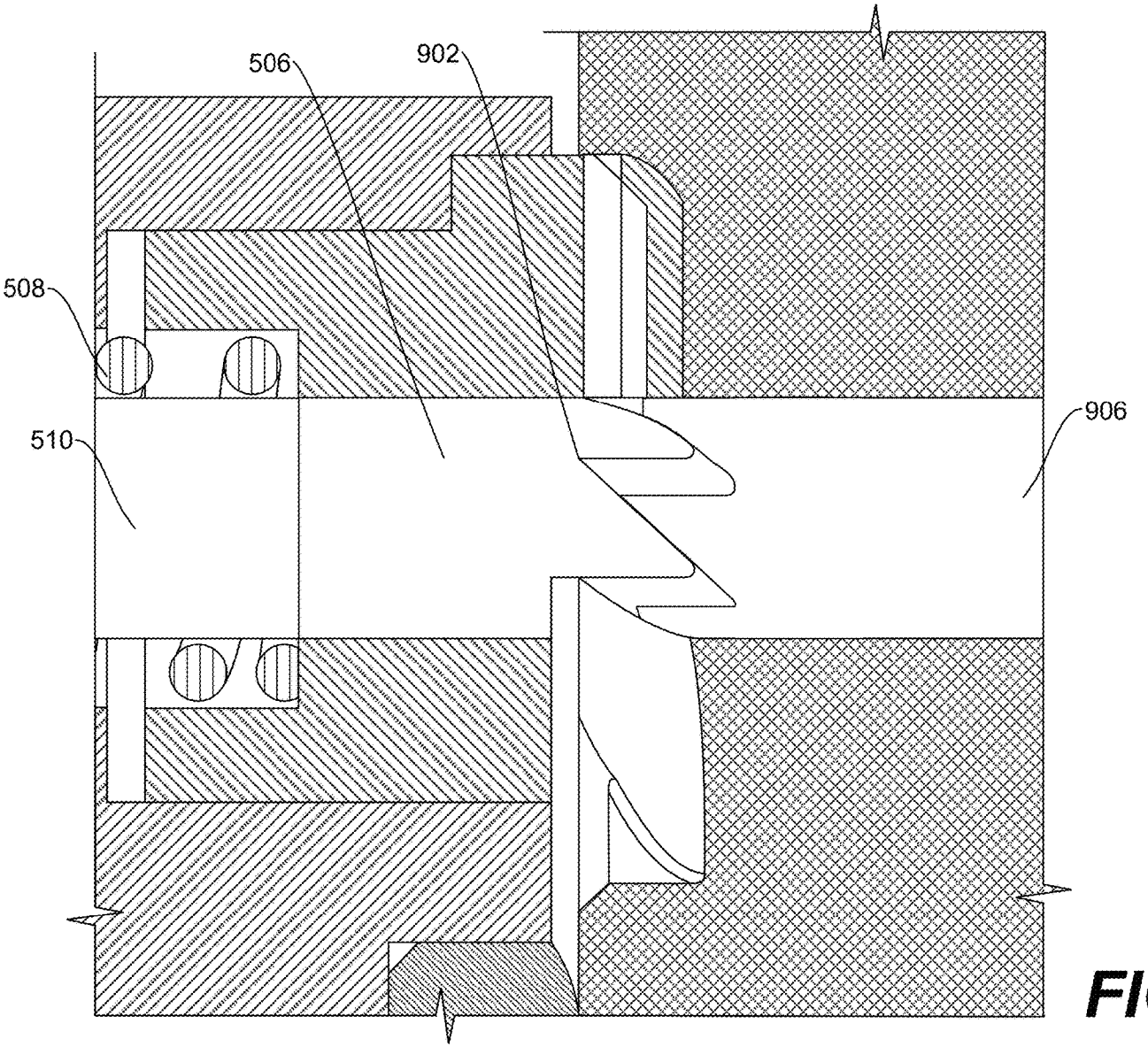
FIGS. 10A-B illustrates a detail view of an interface between a turret of a magazine for a multi-shot airgun and an arbor of the breech, according to at least one example.
Figure 10B:
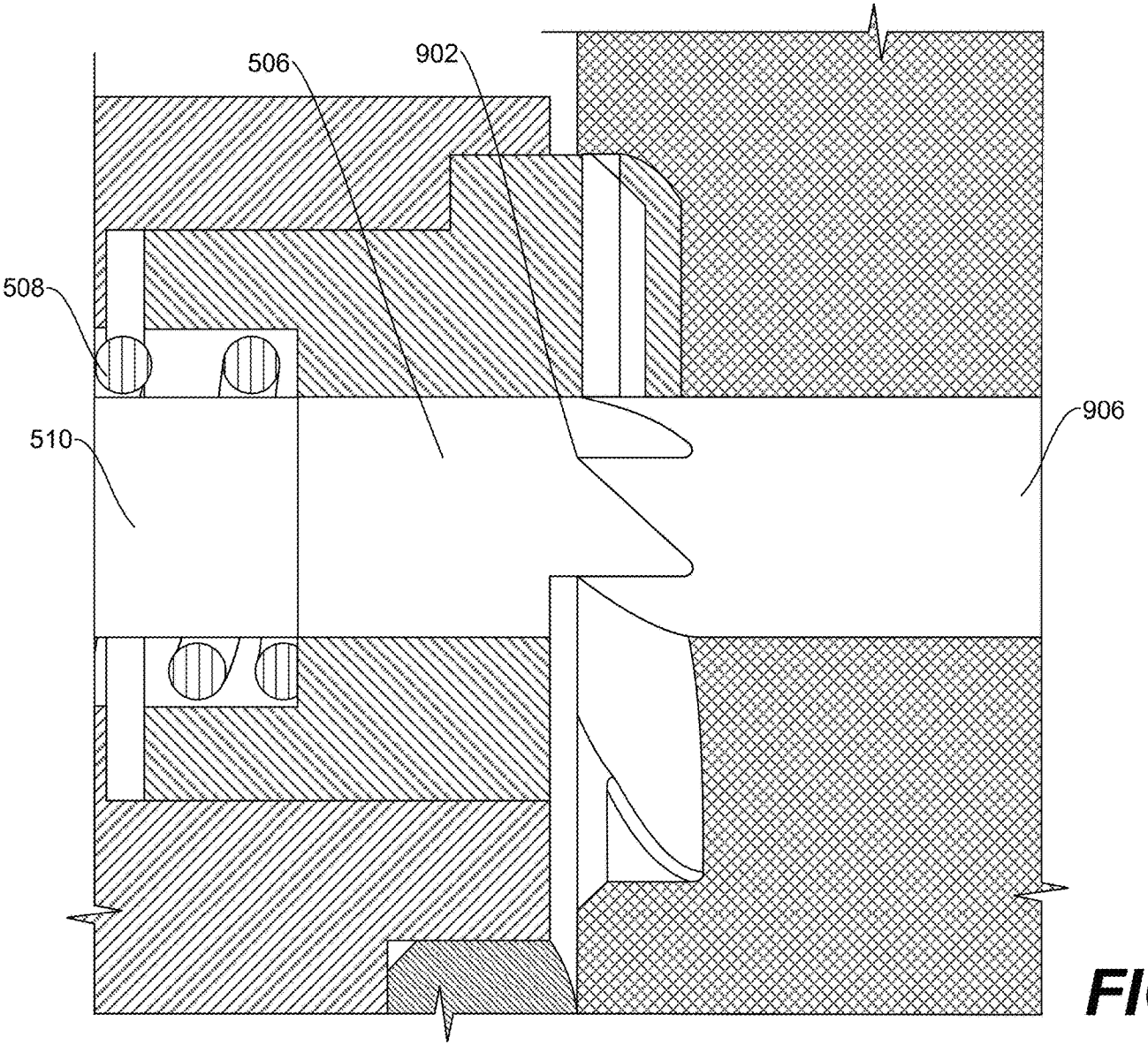

FIGS. 9 and 10A-B illustrates a section view of the barrel-end portion of the breech 102 of FIG. 8 and a magazine for a multi-shot airgun, according to at least one example. The breech 102 includes the magazine 124, passageway 302, projectile holder 304, chamber 306, channel 312, conduit 314, first engagement component 506, spring 508, arbor 510, opening 512, seal 514, channel 516, and seal 518 as described herein. The breech 102 illustrates that the arbor 510 extends through the first engagement component 506 to the magazine 124 where a second end of the arbor 906 engages with a securing component 904 to retain the magazine 124 against the barrel-back surface. The interface between the first engagement component 506 and the magazine 124 is illustrated with respect to FIG. 10B and shows that rotation of the magazine 124 results in an increased distance between the barrel-back surface and the magazine 124 until the magazine 124 reaches a next position of a projectile holder 304, at which point the steps of the engagement components interface to enable the magazine 124 to return to the first position (e.g., closer) with respect to the barrel-back surface.

Figure 11:
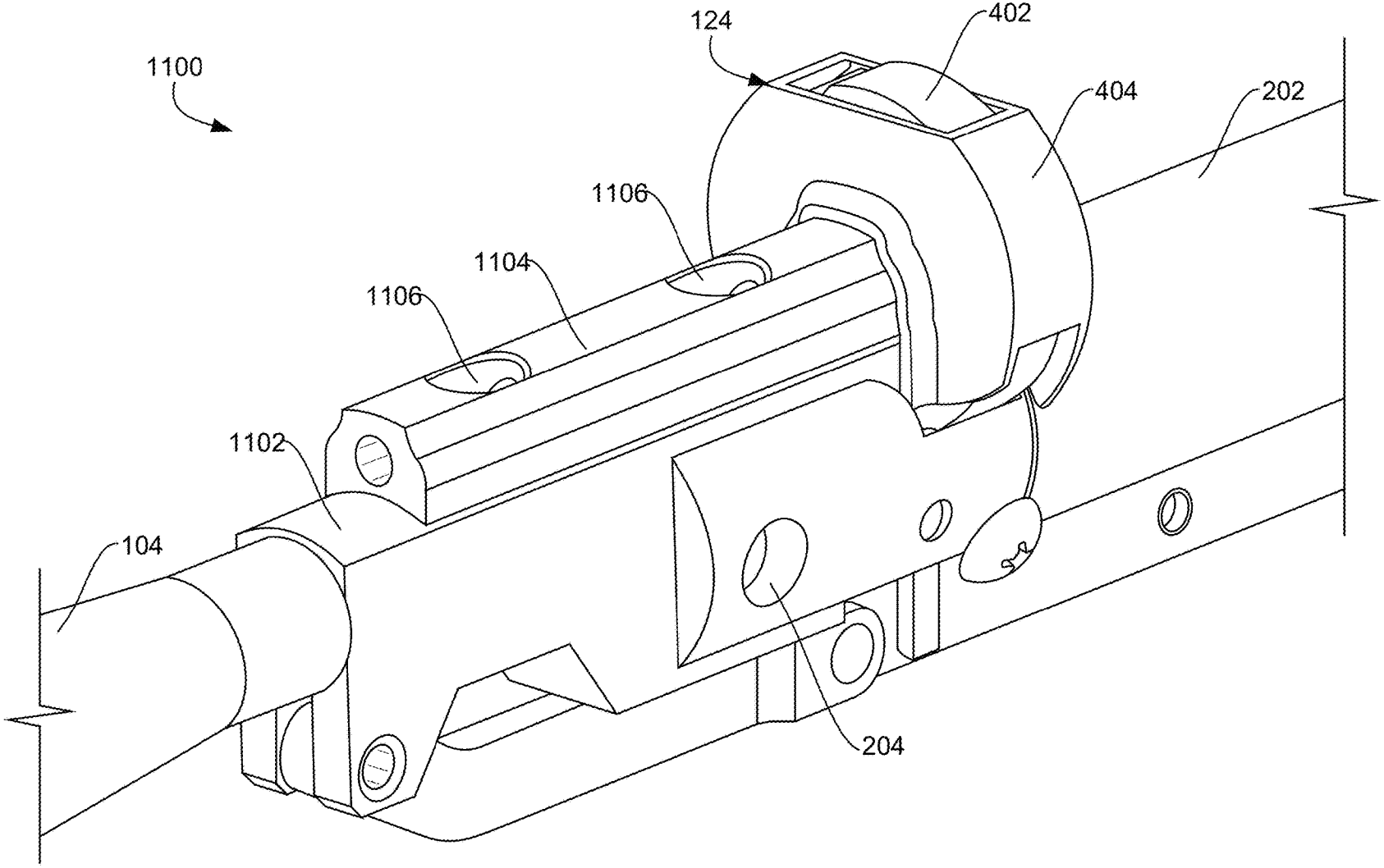
FIG. 11 illustrates a breech portion of a multi-shot airgun with a retrofit magazine holder, according to at least one example.
Figure 12:
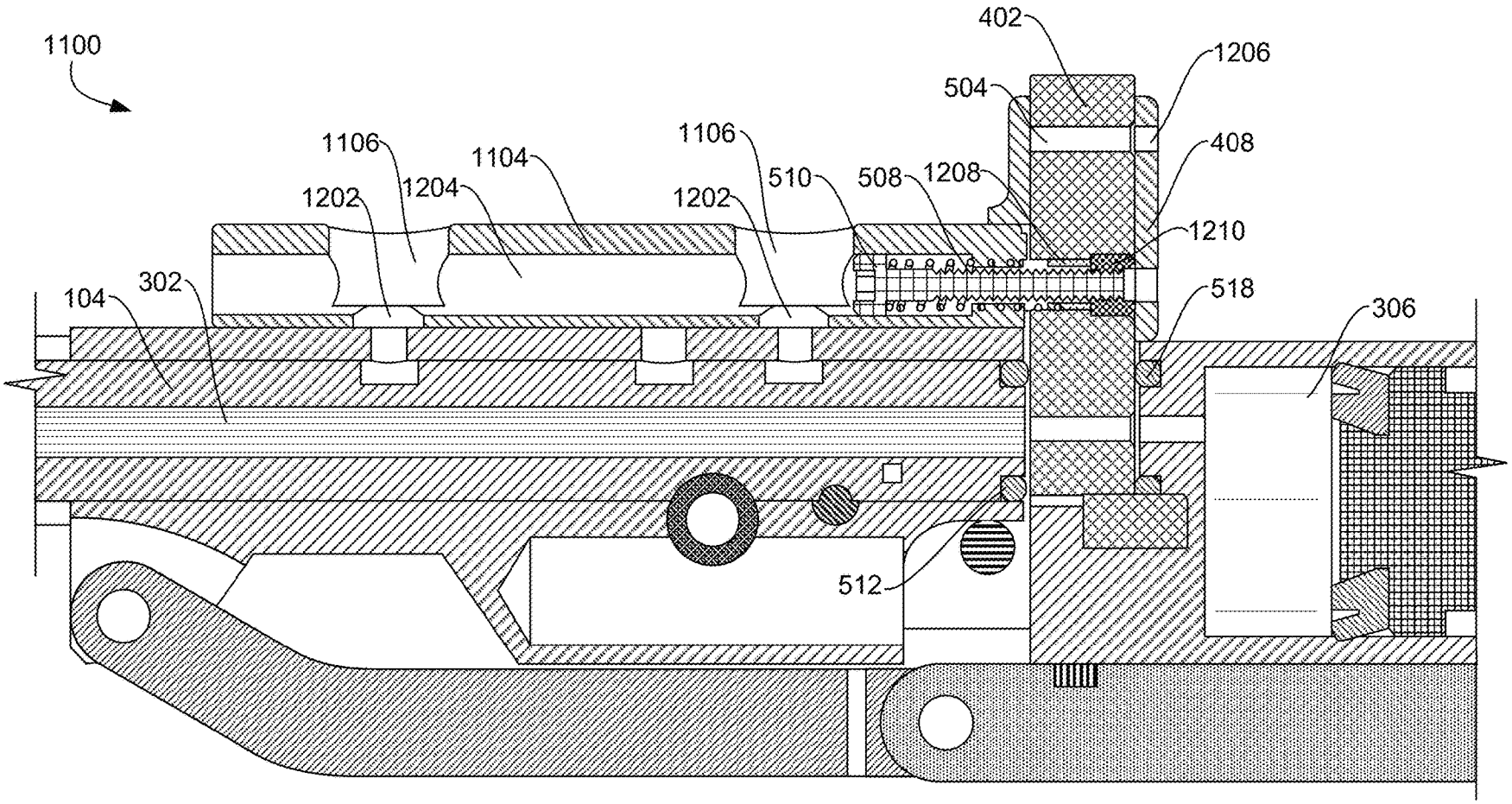
FIG. 12 illustrates a section view of the breech portion and retrofit magazine holder of FIG. 11.

FIGS. 11-12 illustrates a breech portion 1100 of a multi-shot airgun with a retrofit magazine holder 1104, according to at least one example. The airgun 100 includes a barrel 104, stock portion 202, pivot 204, magazine 124, turret 402, and cover 404. The magazine holder 1104 secures to a rail 1102 of the airgun. The magazine holder 1104 secures to the rail 1102 at the openings 1106 through fasteners 1202. The magazine holder 1104 may enable the magazine 124 described herein to be retrofit onto an airgun intended and/or designed for use with a different magazine, chamber, and/or breech design.

The magazine holder 1104 provides a channel 1204 that may be similar and/or identical to the channel 312 described herein. The magazine holder 1104 enables an arbor 510 (illustrated in FIG. 11 as a threaded fastener) to be positioned to accurately support and align the turret 402 and magazine 124. The spring 508 rests around the arbor 510 and the threaded connector 1210 fastens to the end of the arbor 510 to secure the magazine 124 to the arbor 510 and to the magazine holder 1104 similar to the structure for securing the magazine to the channel 312 described herein.

FIG. 13 illustrates a breech portion 1100 for a multi-shot airgun equipped with a retrofit magazine holder 1104, according to at least one example. In the airgun as illustrated, a cocking lever 1304 is joined to barrel 104 between at a first pivot point 1302 and an energy storage device such as a spring or gas piston (not shown) such that as barrel 104 and breech portion 1100 are moved from the firing position to the cocking position and back energy is stored in the energy storage device (e.g., in a compressed gas cylinder). When trigger system is activated, this energy is released to drive a piston (not shown) toward an inner face of chamber 306 so as to force compressed air into the conduit to carry the projectile from the projectile holder 304 through the passageway 302. The cocking lever 1304 is connected, through a second pivot 1306 to a shuttle 1308 that is used to drive the piston that compresses gas or otherwise stores energy at the stock portion 202.

Figure 14:
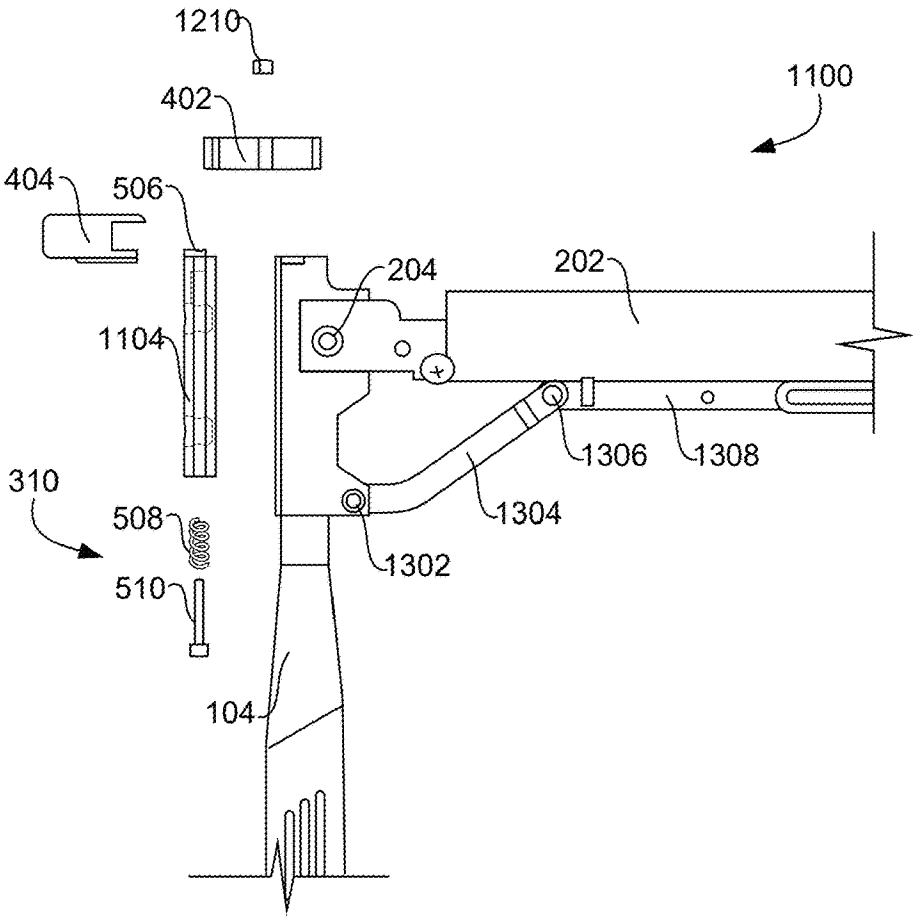
FIG. 14 illustrates an exploded view of the breech portion of the multi-shot airgun of FIG. 13.

FIG. 14 illustrates an exploded view of the breech portion 1100 of the multi-shot airgun of FIG. 13. The breech portion includes a turret 402 as described herein with a plurality of projectile holders 504 distributed around the turret 402. The cover 404 may include passages or openings for viewing whether the projectile holders 504 are loaded or unloaded. The cover 404 also ensures that projectiles in the projectile holders 504 do not fall out or become dislodged during use of the airgun 100.

The magazine 124 is held in place by the magazine holder 1104 that includes multiple components to maintain the magazine 124 in position and enable rotation of the magazine 124 to advance to a subsequent projectile for firing. The magazine holder 1104 includes the channel 1204 described herein as well as an arbor 510, spring 508, and a first engagement component 506.

The arbor 510 is inserted into the channel 1204 with the spring on the arbor 510. An end of the arbor 510 rests within the first engagement component 506. In some examples, the end of the arbor 510 may extend through the first engagement component 506 and into the pivot 502 of the turret 402.

In some examples, the first engagement component 506 may be pressed or secured into the end of the channel 1204 with a passage through the first engagement component 506 such that the arbor 510 passes through and secures into the pivot 502 of the turret 402. In this example, the spring 508 provides a biasing force to maintain the magazine 124, and specifically the engagement component of the magazine 124 to remain in contact and engagement with the first engagement component 506.

The indexing teeth of the first engagement component 506 may include a feature having angled planar surfaces that correspond with the indexing teeth of the magazine 124 and may interact together. The indexing teeth of the first engagement component 506 may include an injection molded component, metal component, composite, plastic, or other such material that is pressed into the breech 102 at the channel 1204 or otherwise held in place while the magazine 124 can freely rotate. The magazine 124 is retained by being secured to the arbor 510 with the spring 508 positioned around the shaft of the arbor to provide a biasing force that allows lateral movement of the magazine 124 in a limited range.

The indexing teeth of the first engagement component and the spring 508 of the magazine holder 126 may interact to bias the magazine 124 into contact and alignment with the magazine holder 126. The angled surfaces of the first engagement component 506 and on the magazine 124 may cause the magazine 124 to move laterally away from the magazine holder 126, for example along an axis aligned with the channel 1204. After the magazine 124 rotates to the next position of a projectile holder, the step of the indexing teeth results in the magazine 124 moving laterally back into contact with the magazine holder 126. Accordingly, the biasing member (e.g., spring 508) and the indexing teeth of the first engagement component 506 may reduce backlash, prevent backwards rotation of the magazine 124, and maintains alignment of the projectile holders with the passageway of the barrel 104.

Figure 15:
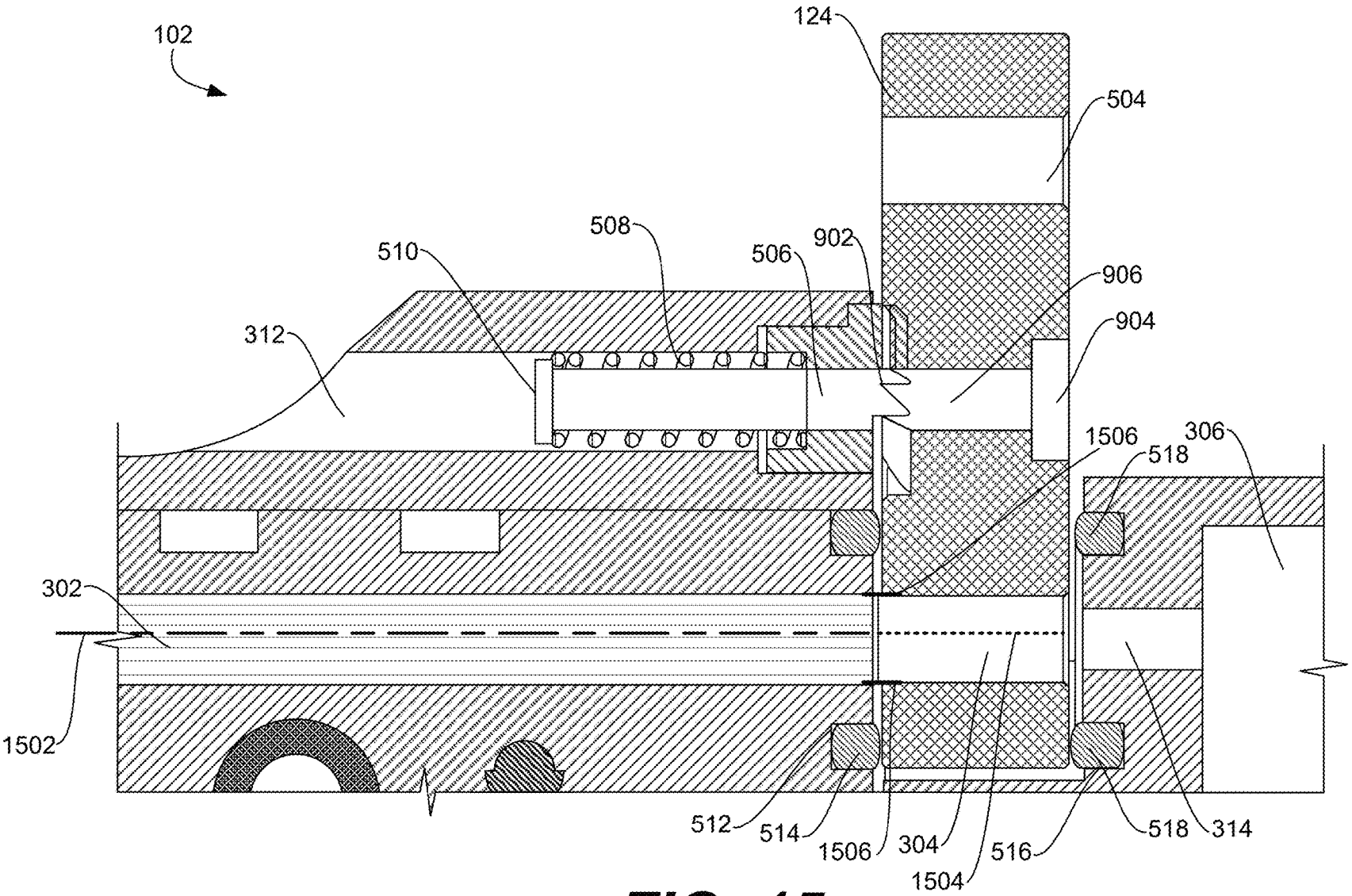
FIG. 15 illustrates a section view of the barrel-end portion of the breech of FIG. 8 and a magazine for a multi-shot airgun, according to at least one example.

FIG. 15 illustrates a section view of the barrel-end portion of the breech 102 of FIG. 8 and a magazine 124 for a multi-shot airgun, according to at least one example. The breech 102 includes the passageway 302, projectile holder 304, chamber 306, channel 312, conduit 314, first engagement component 506, spring 508, arbor 510, opening 512, seal 514, channel 516, and seal 518 as described herein. The section view of FIG. 15 includes indicators showing alignment of the barrel and projectile holders of the magazine 124 to ensure the projectile holder is colinear with the barrel and therefore doesn't misalign with the barrel resulting in damage to a projectile or other effects as a result of misalignment including decreased speed, performance, and accuracy.

In particular, the passageway 302, which includes a barrel passageway has a center axis 1502 1502 that extends along the barrel at a center of the passageway 302 and indicates a central axis of the passageway 302 and the barrel. The projectile holder 304 includes a center axis 1504 that is defined at a center of the projectile holder (e.g., at a center of a circular projectile holder) and extends along the length of the projectile holder 304 from a first side to a second side of the magazine 124. The projectile holder 304 of the magazine 124 is aligned with the barrel when a center axis 1504 of the projectile holder aligns with (e.g., is colinear with) the center axis 1502. In some examples, the projectile holder 304 and the passageway 302 may have a similar and/or identical diameter such that as a projectile ransitions from the magazine 124 to the barrel, the projectile remains moving along the path indicated by the center axis 1502. In some examples, the diameter of the projectile holder 304 may be less than a diameter of the passageway 302. In some examples, the passageway 302 may include a chamfered edge around the lip where the barrel and magazine meet to aid in guiding the projectile along the center axis 1502.

The position of the projectile holder 304 relative to the passageway 302 is maintained by causing the magazine 124 to rotate and seat in a firing position with each rotation of the magazine. In this manner, the magazine 124, as it rotates, always aligns with the passageway 302 due to the interface between the arbor 906 and the first engagement component. Within the breech 102, the arbor 510 extends through the first engagement component 506 to the magazine 124 where a second end of the arbor 906 engages with a securing component 904 to retain the magazine 124 against the barrel-back surface.

The interface between the arbor 906 and the first engagement component 506 provides for consistent placement of the projectile holder 304 relative to the passageway 302. As the magazine rotates, the sloped surfaces of the arbor 906 and the first engagement component 506 engage to slide against each other and push the first engagement component 506 and the arbor 906 apart. The first engagement component 506 is biased by the spring 508 that resists the force separating the first engagement component 506 from the arbor 906. Accordingly, as the interface of the arbor 906 and first interface component 506 rotate around and a vertical (e.g., parallel with a center axis of the arbor 906 and a center axis of the first engagement component 506) portion of the interface of each meets, the spring 508 causes the arbor 906 and the first engagement component 506 to be driven together. The sloped surface and vertical step ensure that the magazine remains rotated in an aligned position where the projectile holder 304 is aligned with the passageway 302. If the magazine 124 is over-rotated (e.g., rotated past a point where the projectile holder 304 and passageway 302 are aligned) then the mbined force of the spring 508 and the sloped interface cause the magazine to counter-rotate back until the interface reaches a stop (where the vertical surfaces meet) and the projectile holder 304 is aligned with the passageway 302.

In some examples, one or both of the first engagement component 506 and the arbor 906 may be made of metal and may be polished to promote sliding of the sloped surfaces against one another to ensure the magazine rotates to an aligned position. The arbor 906 and the first engagement component serve as an anti-backlash mechanism to prevent or minimize free movement of the magazine 124 relative to the breech 102 and ensure alignment of the projectile holder 304. In some examples, the first engagement compopnent 506 and/or the arbor 906 may be formed of a low-friction material, such as a high-density polyetylene or other known low-friction material, coated or covered with such a material, or otherwise have a material applied thereto to reduce friction between the first engagement component 506 and the arbor 906, such as lubricants and oils to name a few non-limiting examples. The interface between the first engagement component 506 and the magazine 124 is illustrated and shows that rotation of the magazine 124 results in an increased distance between the barrel-back surface and the magazine 124 until the magazine 124 reaches a next position of a projectile holder 304, at which point the steps of the engagement components interface to enable the magazine 124 to return to the first position (e.g., closer) with respect to the barrel-back surface.

Figure 16A:
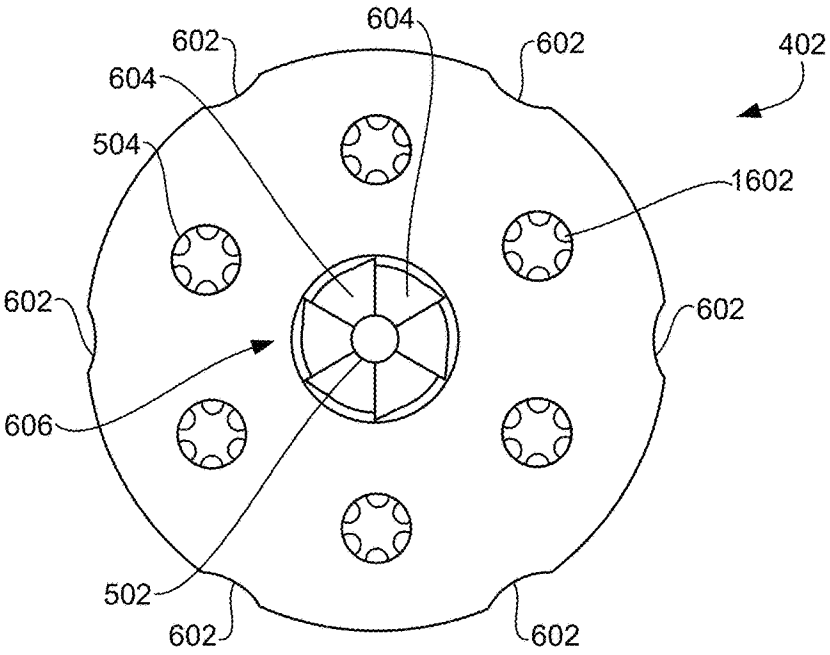
FIGS. 16A-C illustrate a turret for holding pellets in a multi-shot airgun, according to at least one example.
Figure 16B:
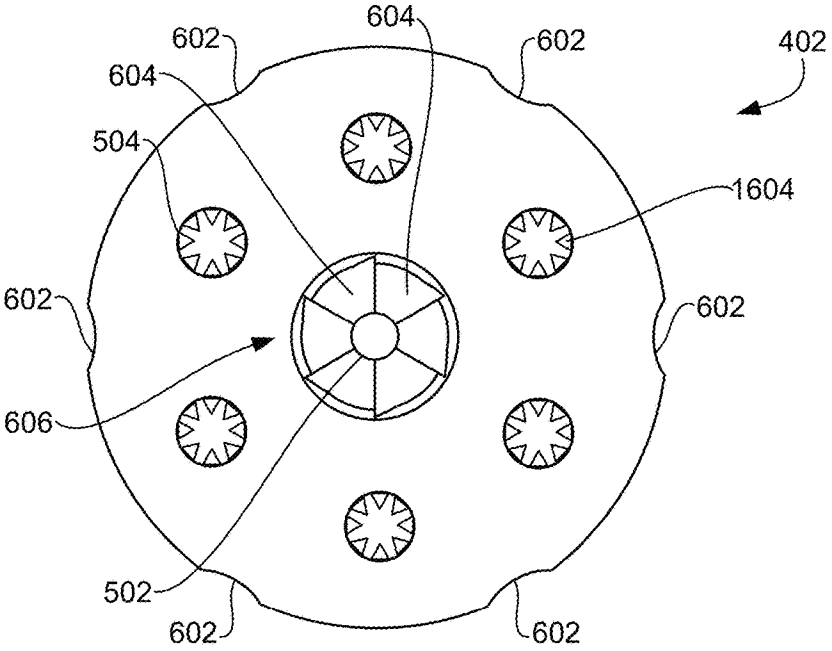
Figure 16C:
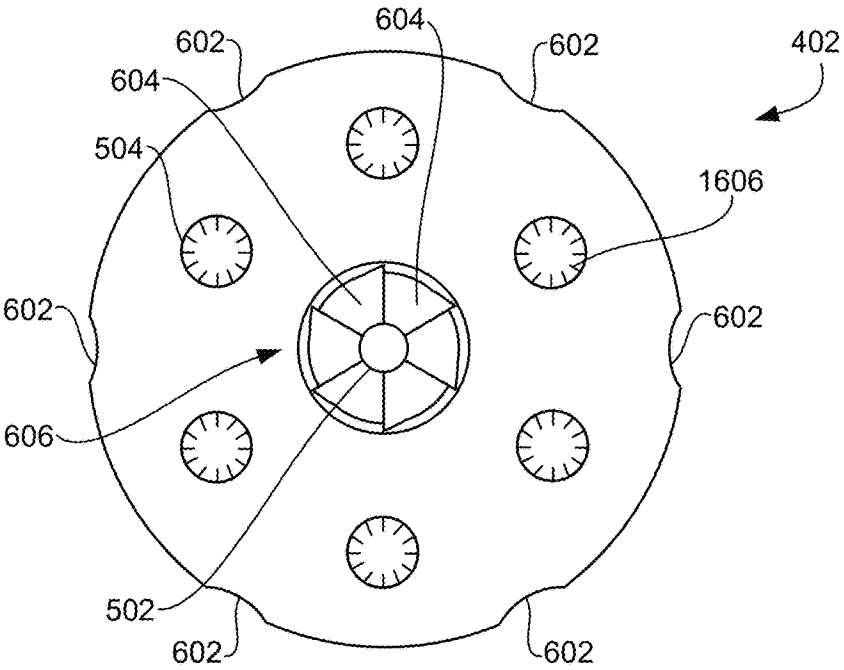

FIGS. 16A-C illustrate an example of a turret 402 for holding pellets in a multi-shot airgun, according to at least one example. The turret 402 includes a pivot 502 at a center of the turret 402 around which the turret 402 may rotate to present projectiles from the various projectile holders 504 to the opening of the barrel 104. The turret 402 includes a second engagement component 606 that may engage with the first engagement component 506 of the breech 102. In some examples, the turret 402 may include protrusions 1602 may extend from an inner surface of the projectile holders 504. The protrusions 1602 are shown extending from the perimeter of the projectile holders 504 and extending towards a center of the projectile holders. The protrusions 1602 may extend into the space formed by the projectile holder 504 to contact and center a projectile within the projectile holder 504. In an example, the protrusions 1602 may be formed of a pliant material such as a rubber or other compressible or deformable material. Accordingly, as projectiles are added to the projectile holder 504, the protrusions 1602, that are spaced evenly around the perimeter, contact the projectile to center it within the projectile holder 504. The protrusions 1602 may have a height, from the wall of the projectile holder 504 of less than a millimeter, such as a height of half a millimeter or less. In some examples, the protrusions 1602 may have a height of a millimeter or more and therefore may be formed of a softer or more compliant material that deforms more easily.

In examples, the protrusions 1602 are designed to cradle and/or support a projectile without introducing excessive force or friction to the projectile that may inhibit firing from the projectile holder 504. Accordingly, the height of the protrusions 1602, materials selected, and shape of the protrusions 1602 may all be configured to limit the frictional forces exerted on the projectile while also maintaining the projectile in alignment with a center axis of the projectile holder 504 as well as the passageway of the barrel for the airgun. The protrusions 1602 are spaced, evenly, around the perimeter of the projectile holder 504 such that contact is made between the projectile and the protrusions 1602, thereby reducing contact area as well as friction as compared with a projectile holder that contacts the projectile around the entire perimeter of the projectile.

In some examples, projectiles fired by an airgun may have a pellet shape that includes a head, a tapered middle section, and a tail that flares outward. This geometry may result in a pellet that has a greater diameter at the hear and/or tail than at a middle portion. The protrusions 1602 extend and contact the pellet to cradle the pellet in a specific orientation (e.g., aligned with a center axis) such that the pellet remains aligned during the loading and firing process.

In a first example, illustrated in FIG. 16A, the protrusions 1602 are illustrated as dome-shaped. The dome-shaped protrusions may deform and compress to accommodate the projectile when inserted. In a second example, illustrated in FIG. 16B, the protrusions 1604 are illustrated as pointed, coming to a point as the protrusions approach a center region defined within the projectile holder 504. The protrusions 1604 may deform radially, in the same manner as the dome-shaped protrusions and may also deform laterally to accommodate the projectiles. In a third example, illustrated in FIG. 16C, the protrusions 1606 are illustrated as fins having a consistent width or thickness from a proximal to a distal end of the protrusions 1606.

The protrusions, such as protrusions 1602, 1604, and 1606 may extend along a length of the projectile holders 504 from a first side of the turret 402 to a second side. In some examples, the protrusions may extend only a portion of the length, such as only extending along a middle portion of the length of the projectile holders 504. In some examples, the protrusions may extend along a length of the projectile holders from a first side to a middle portion of the projectile holders. Extend along a length of the projectile holder 504

Figure 17:
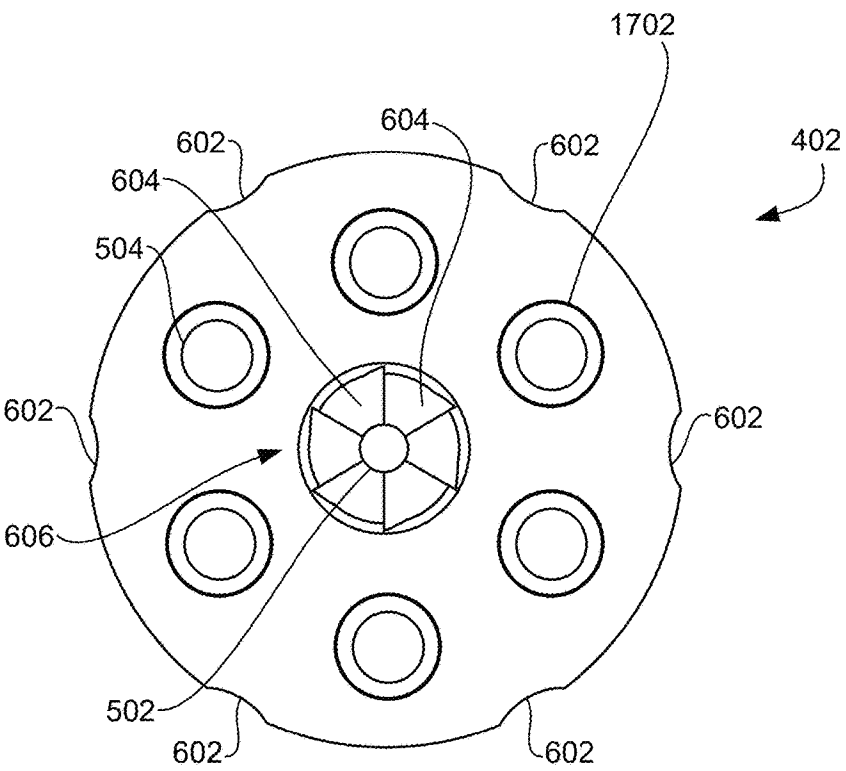
FIG. 17 illustrates a turret for holding pellets in a multi-shot airgun, according to at least one example.

FIG. 17 illustrates a turret 402 for holding projectiles in a multi-shot airgun, according to at least one example. The turret 402 includes a pivot 502 at a center of the turret 402 around which the turret 402 may rotate to present projectiles from the various projectile holders 504 to the opening of the barrel 104. The turret 402 includes a second engagement component 606 that may engage with the first engagement component 506 of the breech 102. In some examples, the turret 402 includes seals 1702 around each of the projectile holders 504. The seals 1702 contact against a face of the barrel, breech, or other component of the airgun to seal air leakage around each projectile holder 504 and therefore each chamber. In some examples, these seals 1702 may be used in place of seals on mating surfaces between the engagement component 802 and the turret 402.

Figure 18:
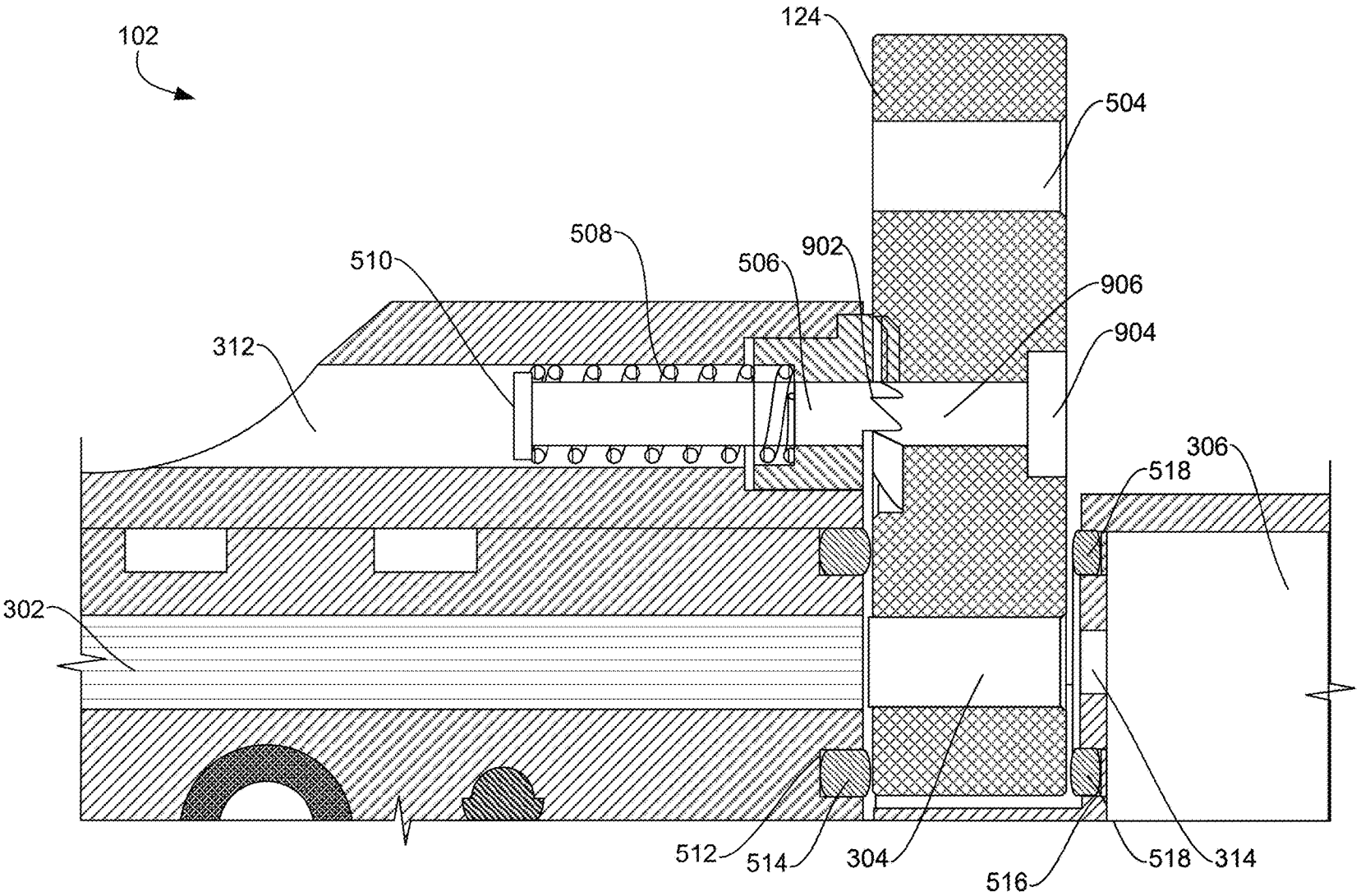
FIG. 18 illustrates a section view of the barrel-end portion of the breech of FIG. 8 and a magazine for a multi-shot airgun, according to at least one example.

FIG. 18 illustrates a section view of the barrel-end portion of the breech 102 of FIG. 8 and a magazine for a multi-shot airgun, according to at least one example. The breech 102 includes the magazine 124, passageway 302, projectile holder 304, chamber 306, channel 312, conduit 314, first engagement component 506, spring 508, arbor 510, opening 512, seal 514, channel 516, and seal 518 as described herein. As illustrated in FIG. 18, a conduit 314 between the chamber 306 where pressurized air is maintained (and subsequently released down the conduit 314) is shortened in length and/or elminated such that the chamber 306 has a port at or adjacent to the opening for a projectile holder 304. In some examples, the "dead space" (i.e., conduit 314) may be reduced so the pressurized gas from chamber 306 is delivered from the chamber 306 more efficiently and without first expanding to pressurize the conduit 314 before reaching the projectile. This reduction of the conduit 314 provides for a reduction in pressure drop before reaching the projectile and therefore increases power transferred to the projectile to increase pojectile velocity for the same chamber pressure.

The invention has been described in detail with particular reference to certain preferred embodiments thereof, but it will be understood that variations and modifications can be effected within the scope of the invention.

What is claimed is:

1. An airgun comprising:

a breech comprising a first face with a port from which a compressed gas can flow;

a barrel defining a passageway through the barrel sized to receive a projectile;

a pivot joining the barrel to the breech such that the barrel can be moved between a firing position and a cocking position;

a rotary magazine comprising:

a turret comprising a plurality of projectile holders arranged around a central axis of the turret; and a first engagement component positioned at a center of the turret; and a magazine holder adapted to position a projectile holder of the plurality of projectile holders in axial alignment with the passageway, the magazine holder comprising:

an arbor;

a spring; and a second engagement component coupled to the arbor and biased into contact with the rotary magazine by the spring, the second engagement component configured to interface with the first engagement component, wherein the first engagement component and the second engagement component together to reduce backlash, prevent backwards rotation of the turret, and provide axial alignment of the plurality of projectile holders with the passageway of the barrel.

2. The airgun of claim 1, wherein the first engagement component comprises a first plurality of angled surfaces, the first plurality of angled surfaces disposed around the central axis of the turret and comprising a step between adjacent angled surfaces of the first plurality of angled surfaces.

3. The airgun of claim 2, wherein the second engagement component comprises a second plurality of angled surfaces, the second plurality of angled surfaces disposed around the arbor and comprising a second step between adjacent angled surfaces of the second plurality of angled surfaces.

4. The airgun of claim 3, wherein the second engagement component comprises:

a first semi-circular portion comprising the second plurality of angled surfaces; and a second semi-circular potion comprising a planar surface.

5. The airgun of claim 3, wherein the first plurality of angled surfaces and the second plurality of angled surfaces comprise low-friction surfaces.

6. The airgun of claim 1, wherein the first engagement component and the second engagement component are configured to interface to translate the turret along the arbor during rotation of the turret from a first position along a length of the arbor to a second position along the length of the arbor before returning to the first position, wherein at the first position, the projectile holder of the plurality of projectile holders is aligned with the passageway.

7. The airgun of claim 6, wherein, at the first position, a seal of the breech is in contact with the turret to seal around the projectile holder.

8. The airgun of claim 1, wherein the plurality of projectile holders each comprise protrusions arranged about an inner perimeter of the plurality of projectile holders configured to contact projectiles positioned within the plurality of projectile holders.

9. The airgun of claim 1, wherein the turret further comprises a plurality of seals, individual seals of the plurality of seals arranged about openings of individual projectile holders of the plurality of projectile holders.

10. An airgun comprising:

a barrel defining a passageway;

an energy storage and release device;

a breech comprising:

a first breech surface comprising an opening connected with the passageway of the barrel; and a second breech surface comprising a conduit connected with the energy storage and release device;

a rotary magazine comprising:

a turret comprising a cylindrical body defining a plurality of projectile holders;

a pivot location positioned at a center of the turret; and a first engagement component positioned around the pivot location; and a magazine holder adapted to position a projectile holder of the rotary magazine in alignment with the passageway, the magazine holder comprising:

an arbor providing a pivotal axis for the turret;

a spring; and a second engagement component coupled to the arbor and biased into contact with the rotary magazine by the spring, the second engagement component configured to interface with the first engagement component to reduce backlash, prevent backwards rotation of the turret, and provide axial alignment of the plurality of projectile holders with the passageway of the barrel.

11. The airgun of claim 10, wherein the first engagement component comprises a first plurality of angled surfaces, the first plurality of angled surfaces disposed around the pivot location of the turret and comprising a step between adjacent angled surfaces of the first plurality of angled surfaces.

12. The airgun of claim 11, wherein the second engagement component comprises a second plurality of angled surfaces, the second plurality of angled surfaces disposed around the arbor and comprising a second step between adjacent angled surfaces of the second plurality of angled surfaces.

13. The airgun of claim 12, wherein the second engagement component comprises:

a first semi-circular portion comprising the second plurality of angled surfaces; and a second semi-circular potion comprising a planar surface.

14. The airgun of claim 12, wherein the first plurality of angled surfaces and the second plurality of angled surfaces comprise low-friction surfaces.

15. The airgun of claim 10, wherein:

the first engagement component and the second engagement component are configured to interface to translate the turret along the arbor during rotation of the turret from a first position along a length of the arbor to a second position along the length of the arbor before returning to the first position, wherein at the first position, the projectile holder of the plurality of projectile holders is aligned with the passageway; and at the first position, a seal of the breech is in contact with the turret to seal around the projectile holder.

16. The airgun of claim 15, wherein the seal of the breech comprises a plurality of seals associated with the plurality of projectile holders.

17. A magazine system for a multi-shot airgun comprising:

a first breech surface comprising a first passageway defined by a barrel of the multi-shot airgun;

a second breech surface comprising a second passageway to an air reservoir;

a rotary turret comprising:

a cylindrical body defining a plurality of projectile holders;

a pivot location positioned at a center of the rotary turret; and a first engagement component positioned around the pivot location, the first engagement component comprising a first plurality of angled surfaces disposed around the pivot location and further comprising a step between adjacent angled surfaces of the first plurality of angled surfaces; and a magazine holder comprising:

an arbor providing a pivotal axis for the rotary turret;

a spring; and a second engagement component coupled to the arbor and biased into contact with the rotary turret by the spring, the second engagement component configured to interface with the first engagement component to reduce backlash, prevent backwards rotation of the rotary turret, and provide axial alignment of the plurality of projectile holders with the first passageway of the barrel.

18. The magazine system of claim 17, wherein the second engagement component comprises a second plurality of angled surfaces, the second plurality of angled surfaces disposed around the arbor and comprising a second step between adjacent angled surfaces of the second plurality of angled surfaces.

19. The magazine system of claim 17, wherein the plurality of projectile holders each comprise protrusions arranged about an inner perimeter of the plurality of projectile holders configured to contact projectiles positioned within the plurality of projectile holders.

* * * * *